US005921765A

United States Patent [19]

Smith

[11] Patent Number: 5,921,765

[45] Date of Patent: Jul. 13, 1999

[54] PERIODIC, ON-DEMAND PRESSURIZED GAS POWER SOURCE AND METHOD OF PROVIDING SAME

[75] Inventor: Bradley W. Smith, Ogden, Utah

[73] Assignee: Atoliv ASP, Inc., Ogden, Utah

[21] Appl. No.: 08/885,096

[22] Filed: Jun. 30, 1997

[51] Int. Cl.[6] ..... F23R 17/00

[52] U.S. Cl. ..... 431/158; 431/8; 431/12; 431/1; 431/346; 60/39.8; 48/192

[58] Field of Search ..... 431/158, 157, 431/1, 2, 8, 11, 12, 346; 239/265.11; 60/39.76, 39.79, 39.8, 39.81, 39.78; 362/380; 48/192

[56] References Cited

U.S. PATENT DOCUMENTS

| | | | |
|---|---|---|---|
| Re. 28,665 | 12/1975 | Zagoroff | 431/347 |
| 2,191,676 | 2/1940 | Nardone | 123/183 |
| 2,634,804 | 4/1953 | Erickson | 158/1 |
| 2,938,337 | 5/1960 | Mirza | 60/39.76 |
| 3,005,485 | 10/1961 | Salgo et al. | 158/7 |
| 3,013,388 | 12/1961 | Loughran | 60/39.46 |
| 3,212,557 | 10/1965 | Perry | 431/157 |
| 3,397,030 | 8/1968 | Pisano et al. | 431/157 |
| 3,819,321 | 6/1974 | Witt | 431/158 |
| 3,880,568 | 4/1975 | Melton, Jr. et al. | 431/1 |
| 3,902,840 | 9/1975 | Baguet | 431/158 |
| 3,926,544 | 12/1975 | Thorpe | 431/114 |
| 3,993,431 | 11/1976 | Oda et al. | 431/158 |
| 4,385,489 | 5/1983 | Abbott | 60/39.8 |
| 4,521,181 | 6/1985 | Delage | 431/207 |
| 4,622,999 | 11/1986 | Ray | 137/599 |
| 4,721,458 | 1/1988 | Conrad | 431/1 |
| 4,740,152 | 4/1988 | Conrad et al. | 431/1 |
| 4,959,009 | 9/1990 | Hemsath | 431/1 |
| 5,111,654 | 5/1992 | Sertich | 60/39.76 |
| 5,330,730 | 7/1994 | Brede et al. | 422/305 |
| 5,336,083 | 8/1994 | Rajewski | 431/346 |
| 5,415,845 | 5/1995 | Brede et al. | 422/305 |
| 5,511,481 | 4/1996 | Stephens | 102/326 |

FOREIGN PATENT DOCUMENTS

| | | | |
|---|---|---|---|
| 0 540 013 | 6/1993 | European Pat. Off. | C06D 5/08 |

*Primary Examiner*—Ira S. Lazarus
*Assistant Examiner*—Josiah Cocks
*Attorney, Agent, or Firm*—Ohlandt, Greeley, Ruggiero & Perle, L.L.P; George W. Rauchfuss, Jr.

[57] ABSTRACT

Periodic, on-demand supply of heated and pressurized gas for use as a power source is provided by a device having a storage compartment storing pressurized, liquified, combustible gas, a pressure regulator attached thereto for feeding the liquified gas to a housing providing a combustion chamber with an ignition element for combustion of the liquified combustible gas. A pressure relief valve releasably seals the combustion chamber from an outlet orifice and operates at a predetermined gas pressure to permit output of combustion gas from the combustion chamber through the output orifice to provide a gas power source for operating a gas powered tool. A check valve prevents combustion of the liquified gas upstream of the combustion chamber.

20 Claims, 2 Drawing Sheets

PERIODIC, ON-DEMAND PRESSURIZED GAS POWER SOURCE AND METHOD OF PROVIDING SAME

FIELD OF THE INVENTION

This invention relates to an apparatus and a device for providing and delivering a portable, high pressure gas source for power users, such as pneumatic actuators and gas powered tools. More particularly, this invention relates to a method and an apparatus and a device for providing and delivering a periodic, on-demand supply of clean, high temperature and high pressure gas to be used as a power source.

BACKGROUND OF THE INVENTION

For the most part, whenever it has been necessary or desirable to provide high pressure gas as a source of power, one has had to employ a compressor powered by an electric or gasoline motor or to utilize large tanks of compressed gas. However, there are quite a few drawbacks to these situations. There may be no convenient source of electrical power to operate an electric motor to power a compressor. Additionally, compressors are not economical for use in operating certain equipment such as small power tools and the like. Moreover, such apparatus is bulky and not easily stored. Use of compressed gas tanks entails the release of cold compressed gas from a large high pressure tank. Again, such a system is unduly large for transport and releases inefficient cold compressed gas.

It is therefore an object of this invention to provide an apparatus or device and a method for providing a periodic, on-demand source of high pressure gas without requiring the use of compressors and a power source to run the compressor, and without the use of large containers of pressurized gas.

A further object of this invention is to provide such a device that is easy to construct and use, is relatively compact, and readily portable for delivering a periodic, on-demand source of high pressure gas.

A further object of this invention is to provide such a device, in which a pressure increase of greater than 8 fold, is obtained in the device.

SUMMARY OF THE INVENTION

One or more of the objects of this invention are obtained by a portable device for supplying a periodic, on-demand, high temperature and pressure gas for use as a power source and wherein the portable device comprises the following components: a storage compartment for a pressurized, liquified combustible gas, a pressure regulator and a housing providing a combustion chamber. The combustion chamber includes a check valve, a spark or a heat producing ignition source such as a spark plug or hot wire filament, optionally a flame suppressor, a pressure relief valve and an output orifice. The storage compartment, which is preferably a storage bottle, houses a pressurized, liquified combustible gas. While any suitable liquified combustible gas is useful in the device of this invention, such liquified combustible gas preferably comprises a mixture of nitrous oxide and a fuel. Preferably, the fuel is ammonia or at least one short chain hydrocarbon. More preferably, the liquified gas comprises a mixture of nitrous oxide with one or several short chain hydrocarbons such as propane, n-butane or isobutane. A particularly preferred hydrocarbon is industrial butane which comprises a mixture of n-butane and isobutane.

Generally the nitrous oxide will comprise from about 60% to about 98% by weight and the fuel from about 2% to about 40% by weight of the combustible mixture. If desired, a coolant could be added to the liquified gas mixture to moderate the combustion thereof. Suitable coolant could be carbon dioxide, water or the like. The weight ratio of coolant to combustible mixture could range from about 70:30 to about 5:95, but preferably ranges from about 15:85 to about 25:75.

The reaction products of the preferred liquified gas mixture consist substantially of the gaseous substances $CO_2$, $H_2O$ and $N_2$. The preferred liquified gas mixtures are particularly suitable for use in this invention due to the fact that they liquify at relatively low pressure of less than about 1000 psi and are therefore quite volume efficient. Ignition of these liquified gas mixtures in the combustion chamber causes the pressure in the combustion chamber to increase greater than 8 fold.

More particularly, the apparatus for supplying periodic, on-demand, heated and pressurized gas of this invention comprises:

- a storage compartment housing pressurized, liquified, combustible gas and having a liquified gas outlet;
- a combustion chamber housing defining a combustion chamber, a liquified gas inlet and a combustion gas outlet;
- means for regulating pressure in fluid communication with the liquified gas outlet for permitting liquified gas of a first predetermined pressure to flow from the storage compartment through the liquified gas outlet to the liquified gas inlet and into the combustion chamber;
- check valve means for permitting flow of pressurized, liquified, combustible gas into the combustion chamber through the liquified gas inlet but preventing propagation of combustion upstream from the combustion chamber;
- pressure relief valve means in fluid communication with the combustion gas outlet for permitting release of heated, pressurized gas from the combustion chamber through the combustion gas outlet upon gas pressure in the combustion chamber reaching a second, higher predetermined pressure level and for preventing flow of gas through the combustion gas outlet upon gas pressure in the combustion chamber declining to a pressure at or below the first predetermined pressure; and
- ignition means for initiating combustion of the pressurized, liquified combustible gas in the combustion chamber.

The method of this invention for providing a periodic, on-demand, heated pressurized gas for use as a power source comprises:

a) providing a liquified gas storage compartment containing a pressurized, liquified combustible gas;

b) providing a combustion chamber in a fluid communication path with the storage compartment, the combustion chamber having an ignition source and a combustion gas outlet;

c) providing a pressure regulator in the fluid communication path and upstream of a check valve in the fluid communication path;

d) providing a pressure relief valve in the combustion gas outlet releasably sealing the combustion chamber;

e) permitting pressurized liquified combustible gas of a first predetermined pressure to flow from the liquified gas storage compartment into the combustion chamber until pressure in the combustion chamber is equal to the first predetermined pressure whereby the check valve interrupts the fluid communication path between the combustion chamber and the liquified gas storage compartment;

f) igniting the pressurized liquified combustible gas in the combustion chamber to increase pressure in the combustion chamber above the first predetermined pressure;

g) opening the pressure relief valve permitting combustion gas to flow from the combustion chamber and be discharged through the combustion gas outlet to a device in need of a gas power source upon the pressure in the combustion chamber reaching a second, higher predetermined pressure, and closing the pressure relief valve to prevent flow from the combustion chamber upon the pressure in the combustion chamber declining to a pressure at or below the first predetermined pressure;

h) repeating steps e), f) and g) one or more times.

BRIEF DESCRIPTION OF THE DRAWINGS

The invention is illustrated by but not limited to the preferred embodiment of the invention shown in the following drawings in which.

DETAILED DESCRIPTION OF THE INVENTION

Figure 1:
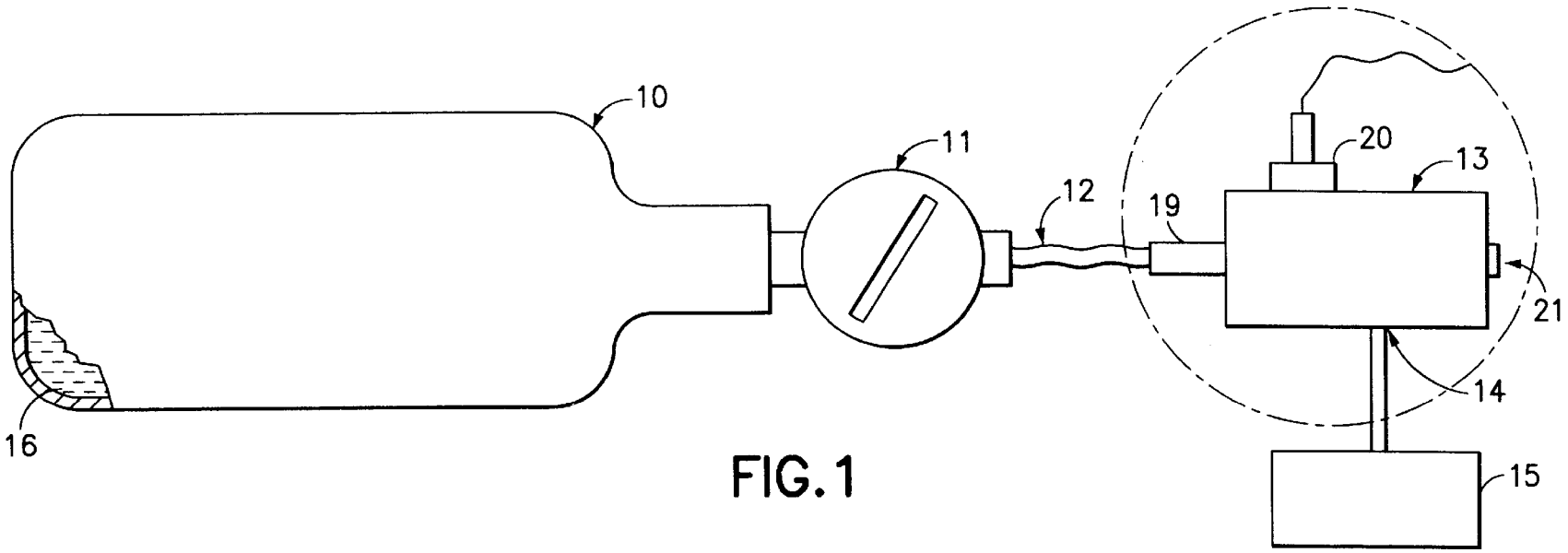
FIG. 1 is a schematic illustration, partly broken away, of the apparatus of this invention.

The apparatus or device as illustrated in FIG. 1 comprises a liquified gas storage bottle 10, a pressure regulator 11, flow conduit 12 and combustion chamber housing 13 having a combustion gas outlet 14 for supplying heated pressurized gas to a device 15 in need of a gas power source, such as a tool or to an accumulator tank.

Figure 2:
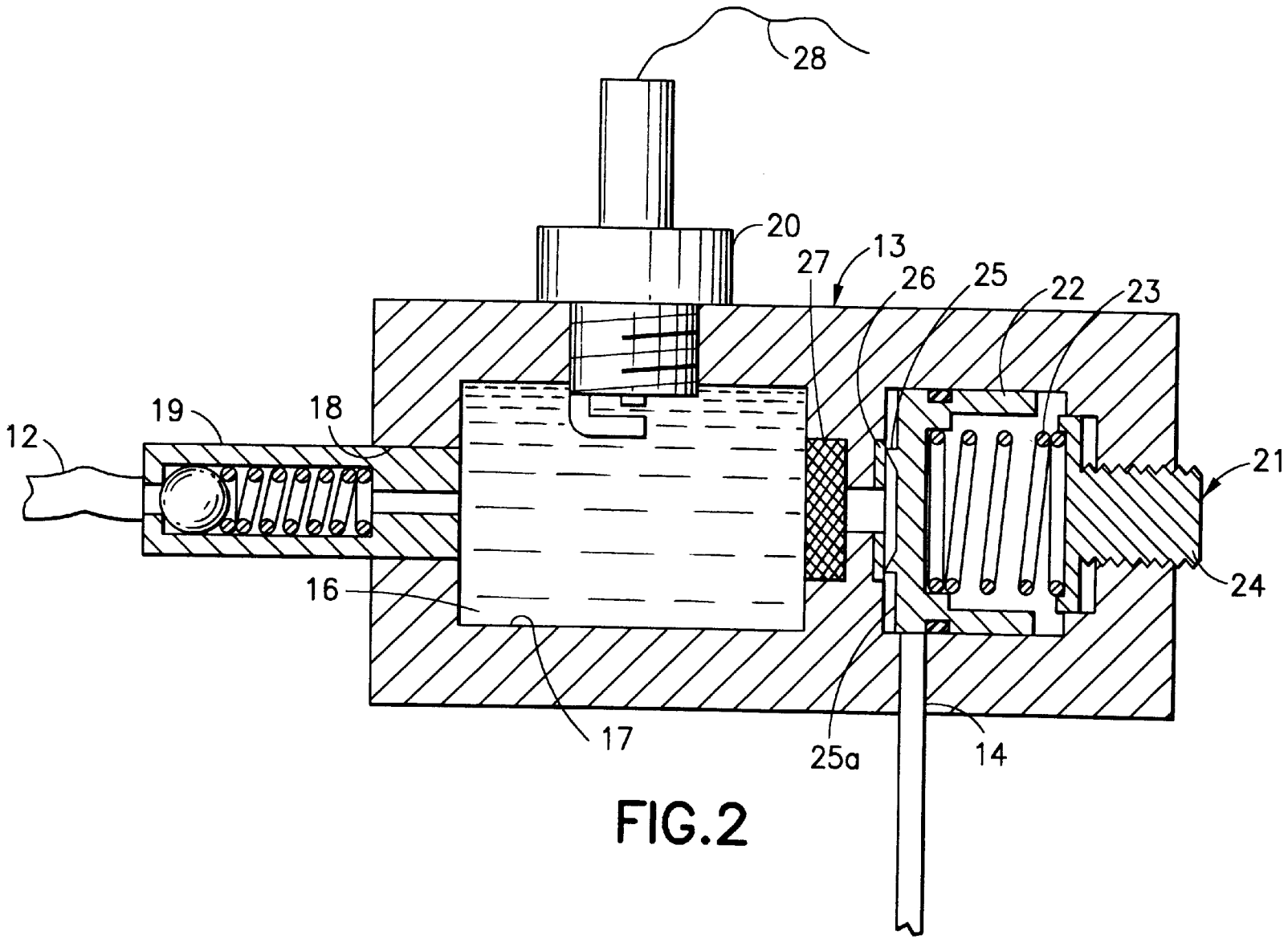
FIG. 2 is a detailed partial cross-section of the area within the broken circle of FIG. 1.

The liquified gas storage bottle 10 stores a pressurized, liquified combustible gas mixture 16, preferably a mixture of about 97.5% nitrous oxide and about 2.5% by weight butane. Pressure regulator 11 controls the flow of pressurized, liquified combustible gas 16 from storage bottle 10 through flow conduit 12 into a combustion chamber 17 (FIG. 2) defined by combustion chamber housing 13. The pressurized, liquified combustible gas 16 in storage bottle 10 may be at a pressure of about 1000 psi and pressure regulator 11 set to permit pressurized gas at about 100 psi to flow into the combustion chamber 17.

The combustion chamber 17 defined by housing 13 includes a liquid gas inlet port 18 in which is located a check valve 19. Check valve 19 operates to permit pressurized, liquified combustible gas 16 to flow from storage bottle 10 into combustion chamber 17 and thereafter close once the gas pressure in the combustion chamber equalizes with the pressure, e.g. 100 psi, of the liquified gas flowing from the storage bottle through pressure regulator 11 and flow conduit 12. Closing of check valve 19 prohibits propagation of combustion upstream from combustion chamber 17. Check valve 19 is preferably a spring-biased ball check valve. An initiator for combustion, such as spark plug 20, is provided in combustion chamber 17. The initiator is connected to a source of power and an actuator (not shown) by lead wire 28.

Combustion gas outlet 14 provides a combustion gas flow path from combustion chamber 17 to a device or accumulator tank 15. In the combustion gas flow path provided by combustion gas outlet 14 there is provided a pressure relief valve 21. Pressure relief valve 21 is preferably a spring-biased piston type relief valve comprising a piston member 22 releasably closing or interrupting the combustion gas flow path by means of a spring 23. Adjustment of the relief valve actuation pressure is set by valve cap 24 threaded into combustion chamber housing 13 to engage spring 23. Piston member 22 is preferably a generally cup-shaped element having a smaller diameter concentric ridge 25 on its bottom surface 25*a* sealing against a sealing member 26 in housing 13 for closing off the combustion gas flow path of gas outlet 14. The size and design of piston 22 and ridge 25 of the pressure relief valve, spring 23 and valve cap 24, are such that, in the embodiment illustrated, the pressure relief valve opens the combustion gas flow path of gas outlet 14 when the pressure in combustion chamber 17 reaches a predetermined pressure, e.g. 200 psi, achieved upon combustion of liquified combustible gas 16 in combustion chamber, and closes the flow path when the pressure in the combustion chamber declines to a pressure at or below the pressure, e.g. 100 psi, set by pressure regulator 11 for permitting liquified combustible gas to flow into the combustion chamber from storage bottle 10.

If desired, a flame suppressor 27 may be located in the combustion gas flow path of gas outlet 14 upstream of pressure relief valve 21 and adjacent combustion chamber 17 for preventing or inhibiting the combustion flame from exiting the combustion chamber. Flame suppressor 27 may preferably be a wire mesh or powdered metal element.

Operation of the device is as follows. Pressure bottle 10 is filled to a pressure of about 1000 psi with a liquified combustible mixture of about 97.5% by weight of nitrous oxide and about 2.5% by weight of a mixture of n-butane and isobutane diluted with liquified carbon dioxide in an amount such that the weight ratio of coolant to combustible mixture is 25:75. Pressure regulator 11 is set at a first predetermined pressure, e.g. 100 psi, permitting the 100 psi liquified gas mixture to flow through conduit 12 and check valve 19 into combustion chamber 17. When the pressure in combustion chamber 17 reaches 100 psi, check valve 19 closes, stopping flow of the combustible gas mixture and sealing off the combustion chamber from storage bottle 10. When it is desired to provide a source of gas power to a device 15, the actuator (not shown) sends an electrical signal to spark plug 20 igniting the liquified gas mixture in combustion chamber 17. Combustion of the liquified gas mixture 16 results in at least an eight-fold increase in pressure causing pressure relief valve 21, set at an actuation pressure of 200 psi, to open permitting heated, pressurized combustion gas to exit combustion chamber 17 and flow through combustion gas outlet 14 to the device 15 to be operated by the gas power source.

Flow of combustion gas out of combustion chamber 17 through gas outlet 14 causes the pressure in the combustion chamber to decline. Upon the pressure in the combustion chamber 17 declining to a pressure below the first predetermined pressure set by pressure regulator 11, e.g. 100 psi, pressure relief valve 21 closes, check valve 19 again opens and the combustion chamber is again filled with the liquified combustible gas mixture 16 from storage bottle 10 and is again ready for ignition at the desired time to provide a further supply of heated pressurized gas as a power source.

With the foregoing description of the invention, those skilled in the art will appreciate that modifications may be made to the invention without departing from the spirit thereof. Therefore, it is not intended that the scope of the invention be limited to the specific embodiments illustrated and described.

I claim:

1. Apparatus for supplying periodic, on-demand, heated and pressurized gas, said apparatus comprising:

a storage compartment housing pressurized, liquified, combustible gas and having a liquified gas outlet;

a combustion chamber housing defining a combustion chamber, a liquified gas inlet and a combustion gas outlet;

means for regulating pressure in fluid communication with the liquified gas outlet for permitting liquified gas of a first predetermined pressure to flow from the storage compartment through the liquified gas outlet to the liquified gas inlet and into the combustion chamber;

check valve means for permitting flow of pressurized, liquified, combustible gas into the combustion chamber through the liquified gas inlet but preventing propagation of combustion upstream from the combustion chamber;

pressure relief valve means in fluid communication with the combustion gas outlet for permitting release of heated, pressurized gas from the combustion chamber through the combustion gas outlet upon gas pressure in the combustion chamber reaching a second, higher predetermined pressure level and for preventing flow of gas through said combustion gas outlet upon gas pressure in the combustion chamber declining to a pressure at or below the first predetermined pressure; and ignition means for initiating combustion of the pressurized, liquified, combustible gas in said combustion chamber.

2. Apparatus according to claim 1 further comprising means for suppressing flame in the combustion gas outlet upstream from the pressure relief valve means.

3. Apparatus according to claim 2 wherein the means for suppressing flame comprises a powdered metal or wire mesh element.

4. Apparatus according to claim 1 wherein the check valve means comprises a spring-biased ball check valve.

5. Apparatus according to claim 1 wherein the pressurized, liquified, combustible gas contains a coolant diluent.

6. Apparatus according to claim 1 wherein the pressurized, liquified, combustible gas in the storage compartment comprises a mixture of nitrous oxide and a fuel, and wherein the fuel is selected from the group consisting of ammonia or at least one short chain hydrocarbon.

7. Apparatus according to claim 6 wherein the pressurized, liquified, combustible gas mixture contains a coolant diluent.

8. Apparatus according to claim 6 wherein the pressurized, liquified, combustible gas in the storage compartment comprises a mixture of from about 60% to about 98% by weight nitrous oxide and from about 2% to about 40% by weight of the fuel diluted with a coolant in a weight ratio of coolant to the mixture of from about 15:85 to about 25:75.

9. Apparatus according to claim 8 wherein the pressurized, liquified, combustible gas in the storage compartment comprises a mixture of nitrous oxide, butane and isobutane.

10. Apparatus according to claim 9 wherein the mixture contains a coolant diluent.

11. Apparatus according to claim 10 wherein the coolant is liquified carbon dioxide.

12. Apparatus according to claim 1 wherein the storage compartment comprises a pressure bottle.

13. Apparatus according to claim 9 wherein the storage compartment comprises a pressure bottle.

14. Apparatus according to claim 12 wherein the ignition means comprises a spark plug.

15. A method for providing a periodic, on-demand heated pressurized gas for use as a power source comprising:

a) providing a liquified gas storage compartment containing a pressurized, liquified, combustible gas;

b) providing a combustion chamber in a fluid communication path with the storage compartment, said combustion chamber having an ignition source and a combustion gas outlet;

c) providing a pressure regulator in said fluid communication path and upstream of a check valve in said fluid communication path;

d) providing a pressure relief valve in said combustion gas outlet releasably sealing the combustion chamber;

e) permitting pressurized, liquified, combustible gas of a first predetermined pressure to flow from the liquified gas storage compartment into the combustion chamber until pressure in the combustion chamber is equal to the first predetermined pressure whereby the check valve interrupts the fluid communication path between the combustion chamber and the liquified gas storage compartment;

f) igniting said pressurized, liquified, combustible gas in said combustion chamber to increase pressure in the combustion chamber above said first predetermined pressure;

g) opening the pressure relief valve permitting combustion gas to flow from said combustion chamber and be discharged through the combustion gas outlet to a device in need of a gas power source upon the pressure in the combustion chamber reaching a second, higher predetermined pressure, and closing the pressure relief valve to prevent flow from the combustion chamber upon the pressure in the combustion chamber declining to a pressure at or below the first predetermined pressure;

h) repeating steps e), f) and g) one or more times.

16. A method according to claim 15 wherein the pressurized, liquified, combustible gas in the storage compartment comprises a mixture of nitrous oxide and a fuel, wherein the fuel is selected from the group consisting of ammonia or at least one short chain hydrocarbon.

17. A method according to claim 16 wherein the pressurized, liquified, combustion gas in the storage compartment comprises from about 60% to about 98% by weight nitrous oxide and from about 2% to about 40% by weight of the fuel.

18. A method according to claim 17 wherein the pressurized, liquified, combustible gas in the storage compartment comprises a mixture of nitrous oxide, butane and isobutane.

19. A method according to claim 15 wherein the pressurized, liquified, combustible gas contains a coolant diluent.

20. A method according to claim 18 wherein the mixture contains a coolant diluent.

* * * * *